US005653141A

United States Patent [19]

Schönau

[11] Patent Number: 5,653,141

[45] Date of Patent: Aug. 5, 1997

[54] COINING PRESS WITH TOGGLE DRIVE

[75] Inventor: Hein Schönau, Salach, Germany

[73] Assignee: Schuler Pressen GmbH & Co., Goeppingen, Germany

[21] Appl. No.: 572,242

[22] Filed: Dec. 13, 1995

[30] Foreign Application Priority Data

Dec. 23, 1994 [DE] Germany ..... 44 46 221.2

[51] Int. Cl.[6] ..... B21J 9/18

[52] U.S. Cl. ..... 72/451; 72/452.5; 100/282

[58] Field of Search ..... 72/450, 451, 452.5; 100/281, 282, 283, 285, 286

[56] References Cited

U.S. PATENT DOCUMENTS

| | | | |
|---|---|---|---|
| 2,781,015 | 2/1957 | Dehn et al. | 72/452.5 |
| 3,456,480 | 7/1969 | Baldyga | 72/451 |

FOREIGN PATENT DOCUMENTS

| | | | |
|---|---|---|---|
| 587093 | 11/1959 | Canada | 72/450 |
| 0 11 590 | 2/1984 | European Pat. Off. . | |
| 74272 | 3/1918 | Germany | 72/451 |
| 257298 | 4/1970 | U.S.S.R. | 100/282 |
| 396272 | 12/1973 | U.S.S.R. | 100/282 |
| 592616 | 2/1978 | U.S.S.R. | 72/450 |
| 1433112 | 4/1976 | United Kingdom | 100/282 |

OTHER PUBLICATIONS

"Dubbel's Pocket Book of Mechanical Engineering", Springer Publication, 12th edition, 1963, pp. 800/801 1963.

*Primary Examiner*—David Jones

*Attorney, Agent, or Firm*—Evenson, McKeown, Edwards & Lenahan P.L.L.C.

[57] ABSTRACT

A coining press is provided with a machine frame, a coining drive for slides and coining dies, an ejector coining die against which the coining die can be pressed with the interposition of the coining blank and can partially yield for this purpose, a drive for the ejector movement of the ejector coining die and one device respectively for feeding the coining blank and for removing the finished coined part. The coining drive has a coupling dwell gear which is hinged to a toggle joint gear. The coupling dwell gear has a connecting rod moved by an eccentric shaft, the longitudinal axis of the connecting rod extending substantially in parallel to the coining plane and the end of the connecting rod facing away from the coining die being hinged to a booster device. The toggle joint gear has three pressure lugs which, on one end respectively, are hinged to one another on a pin while the end of a first pressure lug is hinged to the connecting rod. The other end of a lower pressure lug is hinged to the machine frame while the other end of an upper pressure lug is hinged to the slide.

12 Claims, 5 Drawing Sheets

COINING PRESS WITH TOGGLE DRIVE

BACKGROUND AND SUMMARY OF THE INVENTION

This invention relates to a coining press having a machine frame, a coining drive for slides and coining dies, an ejector coining die, against which the coining die can be pressed with the interposition of the coining blank and, for this purpose, is partially yielding, a drive for the ejector movement of the ejector coining die and one device respectively for feeding the coining blank and for removing the finished coined part.

A coining press of this general type is known from European Patent Document EP-A-0 101 590. In the case of the coining press disclosed in the above-mentioned document, the coining drive takes place by means of a triangle lever which is known per se, is driven by a crankshaft by way of a center bearing and which, by means of its rearward link bracket, is pivotally connected to a control arm and, by way of this control arm, is pivotally connected on the frame side to the slide by means of its forward link bracket by way of a pressure rod. This vibrating system is constructed such that centers of rotation and pivots in their positions with respect to one another permit at least an approximately circular movement for the pressure rod in its center of rotation on the slide at the point in time of its travelling through the rearward dead center.

By means of the above-mentioned arrangement, it is possible to control the linear movement of the slide in such a manner that sufficient time remains in order to remove a coined coin from the coining tool and to insert a new coining blank between two coining operations.

However, in the case of the known coining press, it is a disadvantage that the described coining drive requires a relatively large amount of space, particularly if it is to be used in presses which are to apply pressures of more than 200 t (metric tons) to the coining blank. Since these forces also affect the coining drive, the individual components of the coining drive must be constructed to be correspondingly stable so that the individual components must be provided in relatively large sizes.

Another disadvantage of the known coining press is the relatively large play within the coining drive which results from the large number of joints used.

It is therefore an object of the present invention to eliminate the present disadvantages of the prior art and particularly to provide a coining press which has an overall height which is as low as possible and which has a lower play within the coining drive.

According to the invention, this object is achieved by providing a coining press having a machine frame, a coining drive for slides and coining dies, an ejector coining die, against which the coining die can be pressed with the interposition of the coining blank and, for this purpose, is partially yielding, a drive for the ejector movement of the ejector coining die and one device respectively for feeding the coining blank and for removing the finished coined part, wherein the coining drive is a coupling dwell gear which is hinged to a toggle joint gear, the coupling dwell gear having a connecting rod moved by an eccentric shaft, the longitudinal shaft of the connecting rod substantially largely in parallel to the coining plane and the end of the connecting rod facing away from the coining die being hinged to a booster device, the toggle joint gear having three pressure lugs which, on one end respectively, are hinged to one another on a pin, while the end of a first pressure lug is hinged to the connecting rod, and wherein the other end of a lower pressure lug is hinged to the machine frame and the other end of an upper pressure lug is hinged to the slide.

By providing a coupling dwell gear which has a booster device, a toggle joint gear can be controlled in a simple manner which, in comparison to the toggle joint gear of the prior art, has a much lower overall height because the triangle lever used in the prior art is omitted so that the whole coining drive and therefore also the coining press itself has a lower overall height.

Another advantage of the coining press according to the invention is the reduction of the play of the coining drive because this coining drive has significantly fewer joints than in the case of the known coining presses so that the overall play is reduced which is composed of the play in the individual joints. This reduction of play has a positive effect particularly in the case of frequent load changes which occur in the case of high-speed coining presses.

In addition, because of the combination according to the invention of a coupling dwell gear and a toggle joint gear, a lower eccentricity of the eccentric shaft, which drives the connecting rod of the coupling dwell gear, is required. This results in the advantage that a smaller and therefore lower-cost coupling may be provided between the eccentric shaft and the drive for the eccentric shaft so that the manufacturing costs for the coining press are lower.

Other objects, advantages and novel features of the present invention will become apparent from the following detailed description of the invention when considered in conjunction with the accompanying drawings.

DETAILED DESCRIPTION OF THE DRAWINGS

Figure 1:
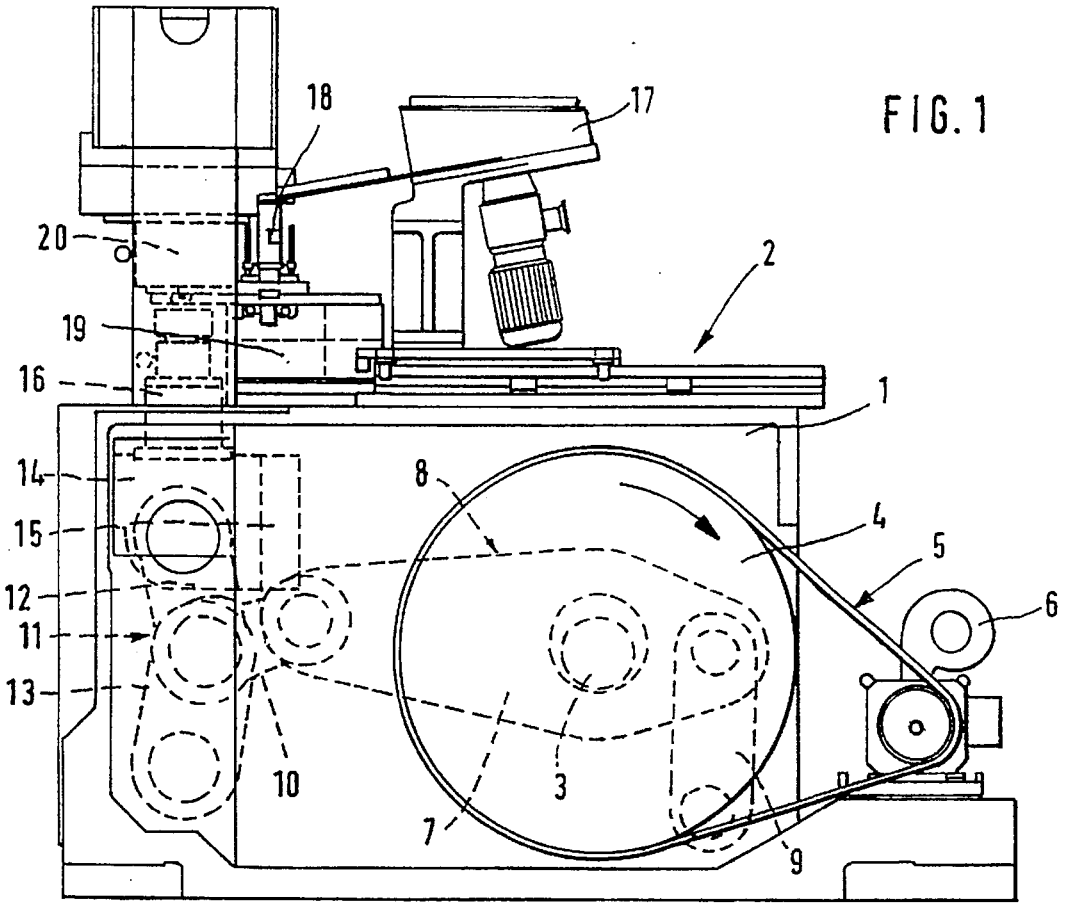
FIG. 1 is a schematic lateral view of a coining press contributed according to a preferred embodiment of the invention.

According to FIG. 1, an eccentric shaft 3 is provided in the machine frame 1 of a coining press 2 and is driven by way of a fly wheel 4 and a belt gear 5 by a motor 6.

A connecting rod 7, which is part of a coupling dwell gear 8, is driven by the eccentric shaft 3. The connecting rod 7 is arranged largely in parallel to the coining plane of a coin (not shown).

In addition, the coupling dwell gear 8 has a booster device which, in the present embodiment, is constructed as a lug 9.

On one end, the lug 9 is hinged to the connecting rod 7 and, on its other end, it is hinged to the machine frame 1.

The connecting rod 7 is displaced eccentrically; more precisely, it is displaced eccentrically along its longitudinal axis onto which the eccentric shaft 3 is placed, in which case the end of the connecting rod 7 facing away from the lug 9 is connected with a pressure lug 10 which establishes a connection between the coupling dwell gear 8 and a toggle joint gear 11.

The toggle joint gear 11 has an upper pressure lug 12 and a lower pressure lug 13 which together with the pressure lug 10 are connected with one another at a point and are disposed in a hinged manner.

On one end, the upper pressure lug 12 is hinged to the slide 14 of the coining press 2 in which case the slide 14 can be linearly displaced in a suitable slide guide 15.

The other end of the lower pressure lug 13 is hinged to the machine frame 1 for pivotal movement about a fixed pivot axis.

The slide 14, in turn, is connected with a slide tool 16 which is arranged above the slide 14 and into which the coining blanks are placed by a feeding drum 17 by way of a feeding station 18 in a dial plate 19 which is provided with a stepping gear.

For the simultaneous coining of the front and back side of the coin, an upper tool 20 is provided above the slide tool 16.

Figure 2:
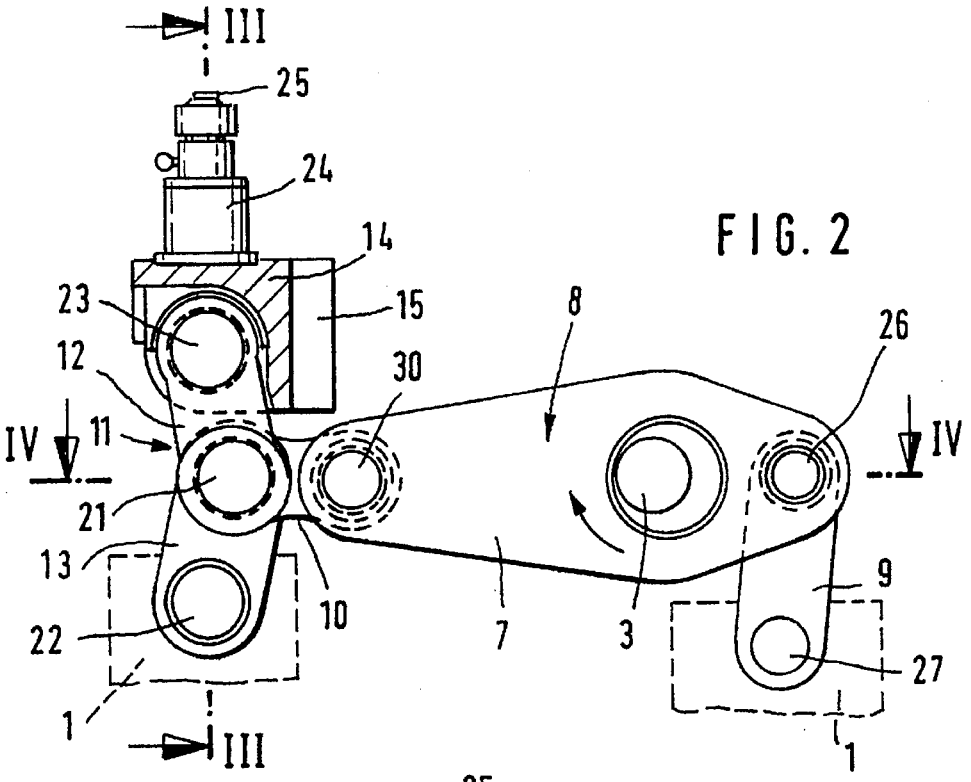
FIG. 2 is an enlarged representation of the coining drive for the coining press of FIG. 1.
Figure 3:
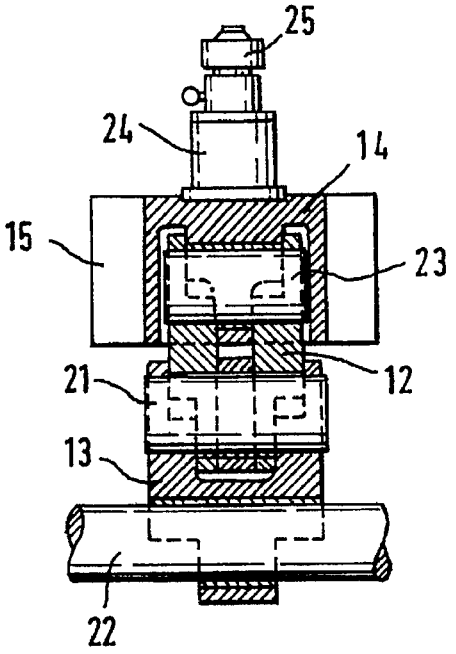
FIG. 3 is a sectional view along Line III—III of FIG. 2.
Figure 4:
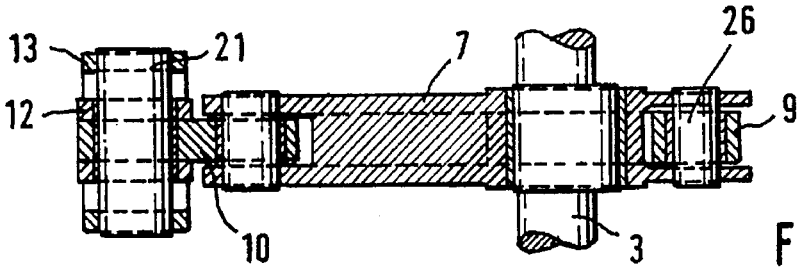
FIG. 4 is a sectional view along Line IV—IV of FIG. 2.

FIGS. 2 to 4 are enlarged representations of the combination described in connection with FIG. 1 consisting of the coupling dwell gear 8 and the toggle joint gear 11.

During a movement of the eccentric shaft 3, the connecting rod 7 will also move. In this case, the movement of the connecting rod 7 is transmitted to the toggle joint gear 11 by way of the pressure lug 10; more precisely, to the upper pressure lug 12 and the lower pressure lug 13. All pressure lugs 10, 12, 13 are hinged to a pin 21 by means of one end respectively.

The end of the lower pressure lug 13 facing away from the pin 21 is mounted in a hinged manner on the machine frame 1 by means of an additional pin 22 for pivotal movement about a fixed pivot axis.

Another pin 23 is used for connecting the end of the upper pressure lug 12 facing away from the pin 21 with the slide 14 which is guided in the slide guide 15.

A tool clamping device 24 for a coining die 25 is provided on the slide 14.

Figure 5:
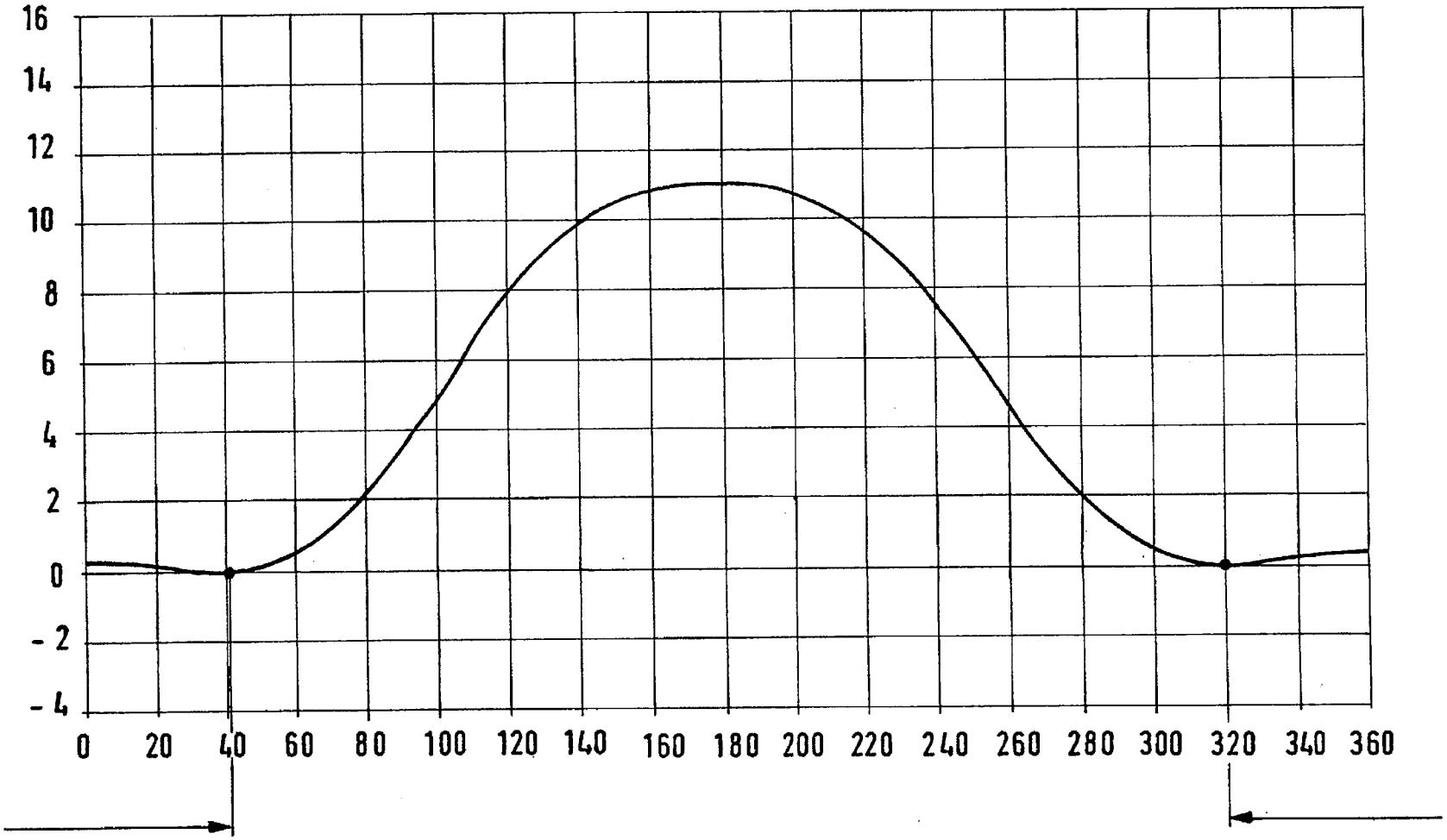
FIG. 5 is a diagram in which the travel of the coining die of the coining press according to FIG. 1 is plotted versus the crank angle of the eccentric shaft.

On the end facing away from the toggle joint gear 11, the connecting rod 7 is connected by means of a pin 26 with the lug 9, in which case the lug 9 is connected on its end facing away from the pin 26 by means of another pin 27 with the machine frame 1 of the coining press. When the eccentric shaft 3 is moved, the slide 14 will move corresponding to the diagram of movements shown in FIG. 5.

With respect to the angle of rotation of the eccentric shaft 3, the slide 14 carries out a coining stroke in a range of a crank angle of approximately 40° to 320°.

In a range of a crank angle of approximately 320° to 40°, however, the slide 14 is lifted only very slightly so that during that time, the slide 14 with all tools mounted on it will be essentially stationary and, during that time, a new coining blank can be brought into the coining station of the coining press by the feeding drum 17, the feeding station 18 and the dial plate 19 (see FIG. 1). Subsequently, a new coining operation may take place.

Figure 6:
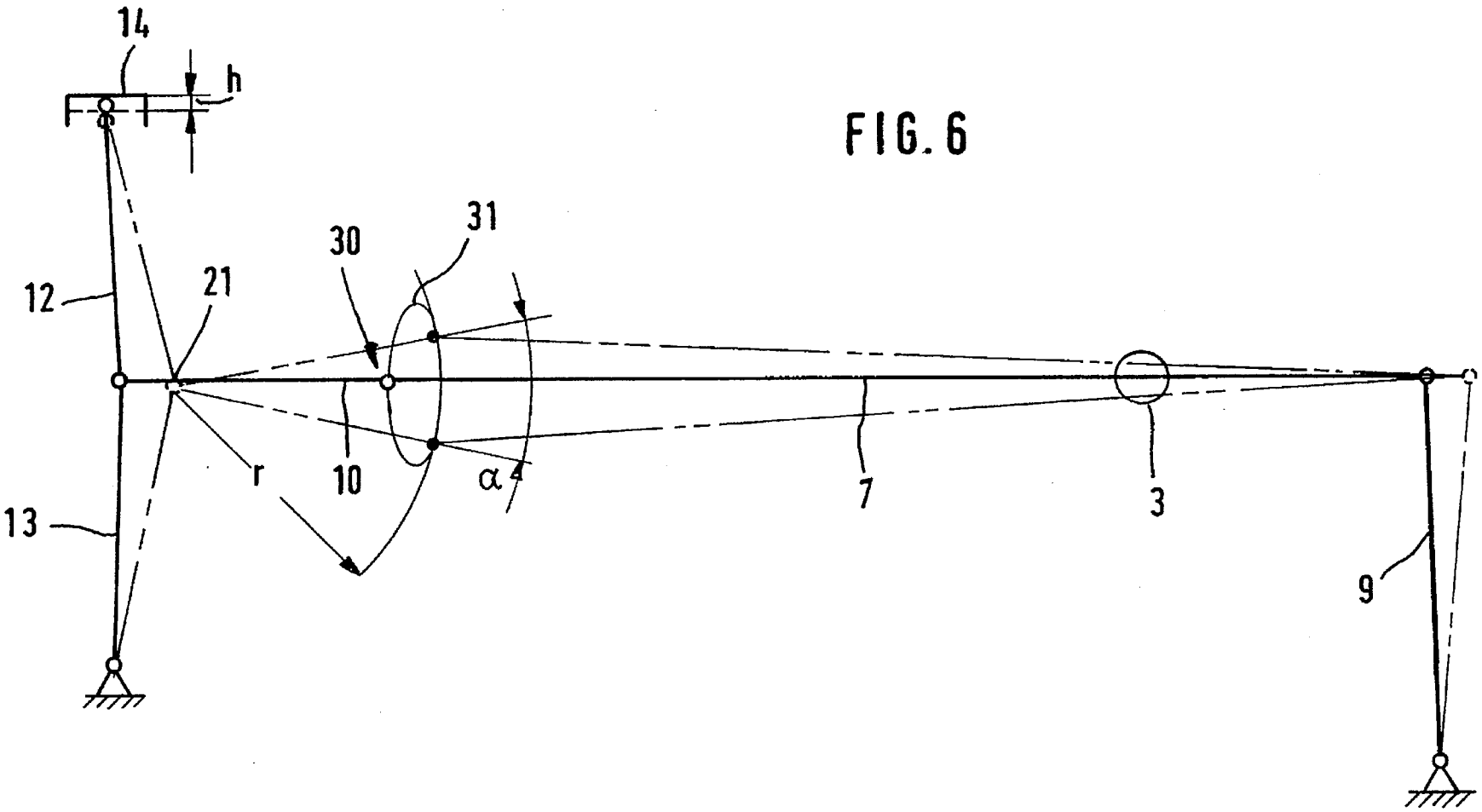
FIG. 6 is a schematic overall view of the used gear combination.

FIG. 6 is a schematic view of the used combination of the coupling dwell gear 8 and the toggle joint gear 11. In this case, particularly the point 30 should be stressed, specifically the connection point or the joint between the pressure lug 10 and the connecting rod 7.

This point moves on a moving path marked with the reference number 31 which partially contains a circular arc with the radius r, in which case the radius r originates in the center point of the pin 21.

Two additional positions of the combination of the coupling dwell gear 8 and the toggle joint gear 11 are illustrated in FIG. 6 by a dash-two-dotted line.

These two positions, between which the angle $\alpha$ extends, form the so-called dwell phase; that is, during this time, a coining blank can be introduced into the coining press or a finished coin can be removed.

At the point on the moving path 31 which is marked with the reference number 30, the upper dead center of the slide 14 is situated; that is, the coining operation takes place at this point.

By providing the described combination of a coupling dwell gear 8 and the toggle joint gear 11, the overall height of the whole coining press 2 can be significantly reduced in a simple manner.

Another advantage of the described construction is a reduction of the eccentricity of the eccentric shaft 3, specifically, for example, from 40 mm to 20 mm so that a coupling can be installed between the motor 1 and the eccentric shaft 3 which is smaller than in the prior art whereby the manufacturing costs for the coining press 2 are reduced. Nevertheless, the stroke of the described coining press 2 corresponds largely to the stroke of known coining presses.

In the present embodiment, the booster device was constructed as a lug 9.

Figure 7:
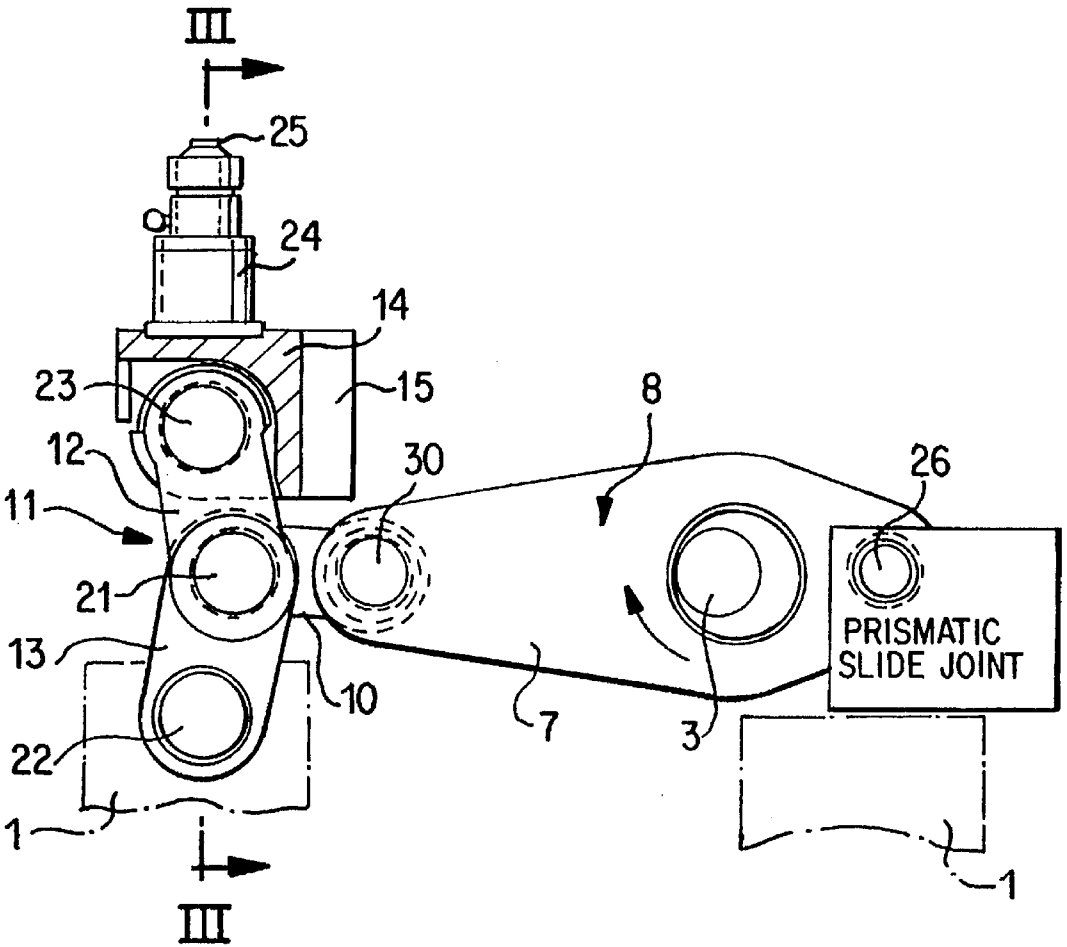
FIG. 7 is a representation according to FIG. 2 illustrating another embodiment of the booster device.

Other suitable components are also contemplated as the booster device 9, such as a prismatic sliding joint (FIG. 7).

The described arrangement also has the advantage that, in the main flux of force of the coining drive, thus from the machine frame 1 by way of the pin 22 through the toggle joint gear to the slide 14, in comparison to the prior art, there are significantly fewer hinge points so that a better force transmission becomes possible.

In contrast to the prior art, as a result of the described arrangement, for example, the operating height of the coining press, in the case of a pressure force of 300 t (metric tons), can be reduced from approximately 1,900 mm to approximately 1,400 mm.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. Coining press including a machine frame and a coining drive arranged on the machine frame, said coining drive carrying a coining die which presses a coin blank having a coining plane, comprising:

a rotatable drive shaft, an eccentric fixed to the drive shaft, a connecting rod carried at the eccentric of the drive shaft, said connecting rod extending substantially in parallel with said coining plane and a toggle joint gear drivingly connected to the connecting rod at a position spaced from the eccentric, said toggle joint gear including first and second pressure lugs having respective first ends hingedly connected to one another at a location in a driving connection with said position, said first pressure lug having a second end hingedly connected to a slide for carrying said coining die, and said second pressure lug having a second end hingedly connected to the machine frame about a fixed pivot axis.

2. Coining press according to claim 1, comprising a booster device hingedly connected to the connecting rod at a position located on a side of the drive shaft which is opposite the connection of the connecting rod with the toggle joint gear.

3. Coining press according to claim 2, wherein the booster device is constructed as a lug.

4. Coining press according to claim 2, wherein the booster device is constructed as a prismatic slide joint.

5. Coining press according to claim 1, wherein said toggle joint gear includes a third pressure lug which has one end pivotally connected to the connecting rod and another end pivotally connected at the hinged connection of the first and second pressure lugs.

6. Coining press according to claim 2, wherein said toggle joint gear includes a third pressure lug which has one end pivotally connected to the connecting rod and another end pivotally connected at the hinged connection of the first and second pressure lugs.

7. Coining press according to claim 6, wherein said coining drive is configured such that the slide is not substantially moved during a substantial part of a complete rotation of said drive shaft, whereby continuous rotation of the drive shaft can be carried out while accommodating coining blank exchanges with a substantially non-moving slide.

8. Coining press according to claim 6, wherein the coining drive is configured so that the slide is moved to carry out a coining stroke during rotational movement of the drive shaft in the range of a crank angle of approximately 40° to 320°, with the slide being substantially stationary in the range of a crank angle of 320° to 40°, whereby continuous rotation of the drive shaft can be carried out while accommodating coining blank exchanges with a substantially non-moving slide.

9. Coining press according to claim 6, wherein the booster device is constructed as a lug.

10. Coining press according to claim 6, wherein the booster device is constructed as a prismatic slide joint.

11. Coining press according to claim 1, wherein said coining drive is configured such that the slide is not substantially moved during a substantial part of a complete rotation of said drive shaft, whereby continuous rotation of the drive shaft can be carried out while accommodating coining blank exchanges with a substantially non-moving slide.

12. Coining press according to claim 11, wherein the coining drive is configured so that the slide is moved to carry out a coining stroke during rotational movement of the drive shaft in the range of a crank angle of approximately 40° to 320°, with the slide being substantially stationary in the range of a crank angle of 320° to 40°, whereby continuous rotation of the drive shaft can be carried out while accommodating coining blank exchanges with a substantially non-moving slide.

* * * * *